US011555357B2

(12) United States Patent
Kirk et al.

(10) Patent No.: US 11,555,357 B2
(45) Date of Patent: Jan. 17, 2023

(54) CENTRALISER

(71) Applicant: Vulcan Completion Products UK Limited, Aberdeen (GB)

(72) Inventors: Ian Kirk, Aberdeen (GB); Andrew Kirk, Aberdeen (GB); Nathan Kirk, Aberdeen (GB)

(73) Assignee: VULCAN COMPLETION PRODUCTS UK LIMITED, Aberdeen (GB)

( * ) Notice: Subject to any disclaimer, the term of this patent is extended or adjusted under 35 U.S.C. 154(b) by 0 days.

(21) Appl. No.: 17/291,714

(22) PCT Filed: Nov. 7, 2019

(86) PCT No.: PCT/GB2019/053151
§ 371 (c)(1),
(2) Date: May 6, 2021

(87) PCT Pub. No.: WO2020/095050
PCT Pub. Date: May 14, 2020

(65) Prior Publication Data

US 2022/0010631 A1 Jan. 13, 2022

(30) Foreign Application Priority Data

Nov. 8, 2018 (GB) ..... 1818210.5

(51) Int. Cl.
*E21B 17/10* (2006.01)

(52) U.S. Cl.
CPC ..... *E21B 17/1028* (2013.01)

(58) Field of Classification Search
CPC .. E21B 17/10; E21B 17/1007; E21B 17/1014; E21B 17/1021; E21B 17/1028; E21B 17/1078
See application file for complete search history.

(56) References Cited

U.S. PATENT DOCUMENTS 2,228,648 A 1/1941 Welles
2,312,600 A 3/1943 Alexander
(Continued)

FOREIGN PATENT DOCUMENTS

CN 204552637 U 8/2015
EP 2158379 3/2010
(Continued)

OTHER PUBLICATIONS

International Search Report and Written Opinion dated Feb. 6, 2020 for corresponding International Patent Application No. PCT/GB2019/053151.

(Continued)

*Primary Examiner* — David Carroll
(74) *Attorney, Agent, or Firm* — Tarolli, Sundheim, Covell & Tummino LLP

(57) ABSTRACT

A centraliser (10) for use in centralising tubing (12) in a bore (W) comprises a first end collar (14), a second end collar (16) and a number of elongate strut members (18). The strut members (18) are interposed between the first end collar (14) and the second end collar (16) and are circumferentially arranged and spaced around the first end collar (14) and second end collar (16). The strut member (18) have a first end portion (20), a second end portion (22), an intermediate portion (24) and angled wing portions (26) which extend from the intermediate portion (24).

20 Claims, 6 Drawing Sheets

(56) References Cited

U.S. PATENT DOCUMENTS

| | | | | |
|---|---|---|---|---|
| 2,727,576 | A | 12/1955 | Hall | |
| 3,289,767 | A | 12/1966 | Seward | |
| 3,289,768 | A | 12/1966 | Solum | |
| 4,787,458 | A * | 11/1988 | Langer | E21B 17/1028 175/325.1 |
| 2003/0000607 | A1 * | 1/2003 | Jenner | E21B 17/1028 29/896.9 |
| 2017/0260816 | A1 * | 9/2017 | Martin | E21B 17/1028 |

FOREIGN PATENT DOCUMENTS

| | | | |
|---|---|---|---|
| GB | 2563239 | A | 12/2018 |
| GB | 2578855 | A | 5/2020 |
| WO | 03002842 | A1 | 1/2003 |

OTHER PUBLICATIONS

GB Search Report dated Apr. 4, 2019 for corresponding GB Application No. 1818210.5.
GB Search Report for Corresponding Application Serial No. GB1818210.5, dated Oct. 25, 2022, pp. 1-3.
GB Examination Report dated Oct. 25, 2022, for corresponding EP application No. GB1818210.5.

* cited by examiner

CENTRALISER

RELATED APPLICATIONS

The present application is a U.S. National Stage application under 35 USC 371 of PCT Application Serial No. PCT/GB2019/053151, filed on 7 Nov. 2019, which claims priority to GB Application No. 1818210.5, filed on 8 Nov. 2018; the entirety of both of which are incorporated herein by reference.

FIELD

This relates to a centraliser for use in centralising tubing in a bore.

BACKGROUND

In the oil and gas exploration and production industry, hydrocarbon bearing formations are accessed by drilling a well borehole ("wellbore") from surface, the wellbore typically then being lined with metal bore-lining tubing known as casing. Sections of casing are typically threaded together to form a casing string which is run into the wellbore, the annulus between the casing string and the wellbore then being filled with a settable material, such as cement, which supports the casing and the wellbore and provides a seal preventing uncontrolled fluid flow up the annulus.

Given that supporting the casing and/or the wellbore and preventing uncontrolled fluid flow up the annulus are critical to ensure the safe operation of a given wellbore, it will be recognised that a poor cementing operation thus poses a significant operational risk for an operator.

One contributory factor to a poor cementing operation is inconsistent thickness of cement in the annulus caused by the casing string deflecting or moving away from the central longitudinal axis of the wellbore. In order to centre the casing string in the wellbore, devices known as centralisers (commonly referred to as "casing centralisers") are typically mounted around the casing string, the centralisers employed to maintain the casing in a generally central position in the wellbore until the sheath of cement surrounding the casing string has set.

Although centralisers are used extensively, there are a number of challenges and drawbacks with conventional tools and equipment.

For example, rigid body centralisers which have fixed radial blades for offsetting the casing string from the wall of the wellbore are not capable of adapting to wellbore restrictions, and thus can inhibit the ability for the casing string to reach the desired total depth in the wellbore.

As an alternative to rigid body centralisers, bow spring centralisers have been developed which have end collars hingedly coupled together by elongate spring elements in the form of bow springs. While the spring elements are capable of deflecting radially inwards to permit the casing string to pass through wellbore restrictions, in high angle or horizontal wellbores (referred to generally as horizontal wellbores") the significant weight of the casing string in the horizontal portion of the wellbore can act to deform the spring elements beyond their capacity to maintain the position of the casing string in the desired position such that the casing string lies towards the low side of the wellbore, and thereby risks uneven cementing of the wellbore as described above.

SUMMARY

According to a first aspect, there is provided a centraliser for use in centralising tubing in a bore, comprising:

a first end collar;

a second end collar; and a plurality of strut members interposed between the first end collar and the second end collar, wherein at least one of the strut members comprises:

a first end portion;

a second end portion;

an intermediate portion interposed between the first end portion and the second end portion; and one or more wing portions extending from the intermediate portion and which are angled relative to the intermediate portion.

In use, the centraliser may be configured for location on tubing, the centraliser configured to engage the bore to centralise the tubing in the bore.

The tubing may comprise bore-lining tubing.

The tubing may comprise bore-lining tubing string.

The tubing may comprise casing.

The tubing may comprise a casing string.

The tubing may comprise a liner.

The tubing may comprise a tool string, work string or the like.

The tubing may comprise a production screen, or the like.

Beneficially, the provision of a centraliser having one or more wing portions which are angled relative to the intermediate portion offsets the intermediate portion from the tubing in use. Offsetting the intermediate portion from the tubing may prevent or at least reduce the risk of damage to the strut member which may otherwise occur if the intermediate portion were subject to a force of sufficient magnitude to otherwise deform the strut member to a flat position relative to end collars.

The intermediate portion may have a greater stiffness than the first and second end portions of the strut member.

Beneficially, the provision of a centraliser having one or more strut members with an intermediate portion having a greater stiffness than the end portions of the strut member provides for preferential flexing of the strut member at the end portions rather than the intermediate portion. The preferential flexing of the strut member at the end portions provides a centraliser having sufficient rigidity to maintain the tubing in a generally central position in the bore while also having sufficient flexibility to pass through bore restrictions and recover to the required shape. The provision of wing portions enhances the stiffness of the intermediate portion.

Moreover, the provision of a centraliser having sufficient rigidity to maintain the tubing in a generally central position in the bore while also having sufficient flexibility to pass through bore restrictions and recover to the required shape may permit the number of strut members to be reduced in comparison to a conventional centraliser. This in turn may reduce the force required to run the tubing into the bore, since frictional forces generated by contact with the surrounding bore are reduced.

The ability to maintain the tubing in the generally central position in the bore while also having sufficient flexibility to pass through bore restrictions and recover facilitates an improved cementing operation (or at least mitigates against the possibility of a poor cementing operation) while increasing the ability to reach the required depth in the bore.

As described above, the centraliser may be configured for location on tubing, the centraliser configured to engage the bore to centralise the tubing in the bore.

In particular embodiments, the centraliser may be configured for location on bore-lining tubing, such as casing, and the bore may comprise a wellbore, the centraliser configured to centralise the bore-lining tubing in the wellbore.

However, the centraliser may take other forms. For example, in other instances the centraliser may form, or form part of, a sub forming part of a bore-lining tubing string. In other instances, the centraliser may be configured for location on a tubing string, such as a tool string, work string or the like, configured to be run into bore-lining tubing, the centraliser configured to centralise the tubing string in the bore-lining tubing.

The first end collar and the second end collar may be configured, e.g. sized and/or shaped, to facilitate location of the centraliser on the tubing.

The strut members may be configured, e.g. sized, shaped and/or having sufficient flexibility, to facilitate engagement with the bore.

As described above, the centraliser comprises a first end collar, a second end collar and a plurality of strut members.

In particular embodiments, the centraliser comprises a unitary construction. That is, the first end collar, second end collar and the strut members may be integrally formed.

Alternatively, the strut members may comprise separate components and the strut members may be coupled to the first end collar and the second end collar. In such embodiments, the centraliser may comprise a coupling arrangement for coupling the strut members to the first end collar and the second end collar. The coupling arrangement may, for example, comprise a hinge arrangement for coupling the strut members to the first end collar. The coupling arrangement may, for example, comprise a hinge arrangement for coupling the strut member to the second end collar.

The centraliser may be configurable in a first, larger diameter, configuration.

In the first configuration, the centraliser may define a larger outer diameter than the outer diameter of the first and second end collars.

In the first configuration, the intermediate portion may assume a radially extended position.

The centraliser may be configurable in a second, smaller diameter, configuration.

In the second configuration, the centraliser may define a larger outer diameter than the outer diameter of the first and second end collars but a smaller outer diameter than when in the first configuration.

In the second configuration, the intermediate portion may assume a radially retracted position relative to the first configuration.

The centraliser may be reconfigurable from the first, larger diameter, configuration to the second, smaller diameter, configuration.

The centraliser may be reconfigurable from the second, smaller diameter, configuration to the first, larger diameter, configuration.

The strut members may be configured to permit reconfiguration of the centraliser between the first configuration and the second configuration.

In use, the centraliser may be reconfigured from the first configuration to the second configuration on encountering a restriction in the bore to permit the centraliser to traverse the restriction. The centraliser may be reconfigured from the second configuration to the first configuration when the centraliser has passed through the restriction in the bore.

The centraliser may be biased towards the first, larger diameter, configuration.

In use, the centraliser may normally define the first configuration but may be reconfigured to the second configuration on encountering a restriction in the bore, the centraliser returning to the first configuration when the restriction has been traversed.

Beneficially, while the centraliser in the second configuration defines a smaller outer diameter than in the first configuration, the strut member in the second configuration are offset from the tubing, thereby preventing or at least reducing the risk of damage to the strut member which may otherwise occur.

As described above, at least one of the strut members comprises one or more wing portions extending from the intermediate portion and which are angled relative to the intermediate portion.

The wing portion may extend inwards, that is generally towards the tubing to be centralised.

The wing portion may define any non-zero angle relative to the intermediate portion up to and including 180 degrees. It will be understood that an angle of 180 degrees would mean that the wing portion is folded back towards and runs parallel to the intermediate portion.

The wing portion may define a non-zero angle relative to the intermediate portion up to and including 90 degrees or about 90 degrees.

In particular embodiments, the wing portion may define an angle of 90 degrees or about 90 degrees relative to the intermediate portion.

The wing portion may define a non-zero angle relative to the intermediate portion of or about 10, 20, 30, 40, 50, 60, 70, 80, 100, 110, 120, 130, 140, 150, 160, 170 degrees relative to the intermediate portion.

In particular embodiments, the strut member comprises two wing portions.

The wing portions define the same angle with respect to the intermediate portion.

However, the wing portions may alternatively define different angles.

The wing portions may be integrally formed with the intermediate portion.

For example, the wing portions may be formed by a bend or folded portion of the intermediate portion.

Alternatively, the wing portions may be coupled to the intermediate portion.

The wing portions may be coupled to the intermediate portion by any suitable coupling e.g. by a weld connection, an adhesive bond, a mechanical fastener.

At least part of the wing portions may be curved.

The wing portions may be curved in a circumferential direction.

The wing portions may be curved in an axial direction.

As described above, the centraliser may be reconfigurable to/from the first configuration and the second configuration.

The first and second end portions of the strut members may be configured to permit reconfiguration between the first, larger diameter, configuration and the second, smaller diameter, configuration.

The first and second end portions may be relatively more flexible than the intermediate portion.

The first and second end portions may be relatively less stiff than the intermediate portion.

The first and second end portions may comprise at least one flexible portion.

The end portions may be configured to be at least one of: flexible, bendable, twistable, deformable, or the like.

The end portions may be flexible, or configured to be flexible, bendable, twistable, deformable, or the like, in any appropriate way.

It will be appreciated that the term "flexing" may refer to bending, twisting, distortion, deformation, and/or any other form of movement of the intermediate portion.

It will be appreciated that at least one feature or component of the centraliser may be curved in one or more than one direction.

At least part of the end portions may be curved.

The curved section may be defined in any direction in relation to the centraliser.

The curved section may be defined in a direction along the member (e.g. the direction may be defined between one end collar to the other end collar or parallel to an axis of the centraliser).

The curved section may be defined in a direction across the member (e.g. the direction may be defined circumferentially around an axis of the centraliser, or may be considered perpendicular to the direction defined between the end collars).

The end portions may comprise a non-curved section or curved section defining a second radius of curvature.

The non-curved section or curved section defining a second radius of curvature may be defined in a direction across the member.

The non-curved section or curved section defining a second radius of curvature may be defined in a direction along the member.

The second radius of curvature may be greater than the first radius of curvature.

The non-curved section or curved section defining a second radius of curvature may be for permitting movement of the intermediate portion between the radially outer and inner positions.

Providing end portions having a greater radius of curvature than the intermediate portion may provide a degree of flexibility for the end portions that is greater than the flexibility of the (smaller radius of curvature) intermediate portion.

As described above, the end portions may be configured to be less stiff than the intermediate portion.

The end portions may each comprise at least two connectors for connecting the respective end portion to the respective end collar.

The connectors of each end portion may diverge from the intermediate portion. The connectors may be spaced apart at the end collars.

Spacing the connectors of each end portion apart may help to distribute an externally applied load more equally, e.g. circumferentially, around the end collar.

If an external load is applied to the intermediate portion, which may in turn be transferred to the first and second end portions, the load may be transferred to the connectors. By spacing the connectors of each end portion apart, the load on each connector may be reduced, which may reduce stress on each connector. Spacing the connectors apart may help to control bending, torsional, or any other forces on the end portions, which may otherwise distort the end portions to such an extent to prohibit or adversely affect recovery of the centraliser to the larger diameter configuration.

The end portions may be bifurcated.

The connectors may define a forked or split connector for transferring force between the end portions and the end collars.

The connectors may comprise or define curved edges.

As described above, the end portions may be configured to be less stiff than the intermediate portion.

The space between the connectors may define an aperture, which may have curved edges.

The aperture may define a tear-drop or triangular shape, which may have larger width proximal to the end collar and distal to the intermediate portion.

The curved edges of the connectors may help to distribute load more evenly, e.g. to reduce or relieve stress on the connectors.

The end portions may comprise a curved section, which may be defined in a direction at least one of: across; and along the member.

The curved section may be proximal to the respective end collar and distal to the intermediate portion.

The curved section may be for providing the curved section with relatively less flexibility than another part of the end portions.

The end portions may each define a transition portion.

The transition portion may be between a curved section of the intermediate portion and a curved section of the respective end collar. The transition portion may comprise a larger radius of curvature than at least one of: the curved section of the intermediate portion; and the curved section of the respective end collar.

The transition portion may comprise or define a flat, or relatively less curved, portion of the member, which may be relatively more flexible than at least one of: the intermediate portion and the end collar.

The end collar and/or the intermediate portion may be less flexible than the transition portion.

The transition portion may help to spread load or stress along the end portion, or at least soften the transition between the relatively less flexible components, so that load or stress may be less concentrated on the more flexible components.

If the end portion comprises a curved section for at least partially resisting flexing, twisting or deformation of the curved section of the end portion, the transition between the end collar (which may be relatively stiff) and the end portion (which may be relatively flexible) may be softened, which may help to spread load or stress along the end portion.

The curved section of end portion may be defined in a direction circumferentially around the centraliser.

The intermediate portion may form or define a paddle of the blade.

The intermediate portion may be relatively less flexible than the first and second end portions.

The intermediate portion may comprise at least one rigid portion.

The intermediate portion may be configured to be resistant to at least one of: flexing, bending, twisting, deforming, or the like.

The intermediate portion may be rigid, or configured to be resistant to flexing, bending, twisting, deforming, or the like, in any appropriate way.

At least part of the intermediate portion may be curved.

The intermediate portion may comprise a curved section.

The curved section may be defined in a direction across the member.

The curved section may be defined in a direction along the member.

The curved section may define a first radius of curvature, which may correspond to the direction across the member and/or the direction along the member.

The curved section may be for providing the intermediate portion with relatively less flexibility than the end portions.

The intermediate portion may comprise or define a curved or convex outer surface. The curved or convex outer surface may be defined in a direction along the members or may be defined between the end collars of the centraliser. The end portions may comprise or define a curved or concave outer surface, which may be defined in a direction along the members or may be defined in a direction between the end collars of the centraliser.

The transition portion may comprise the concave outer surface.

The intermediate portion may comprise or define a curved or convex outer surface, which may be defined in a direction across the members or may be defined in a direction defined between adjacent members of the centraliser.

The intermediate portion may comprise a ridge, rib, protrusion, or the like, which may reduce the contact area between the intermediate portion and the bore wall.

As described above, the centraliser comprises a plurality of strut members at least one of which comprises a first end portion, a second end portion, an intermediate portion and one or more wing portions.

While in particular embodiments, the end portions and intermediate portion may define different shaped portions, e.g. with different curved portions, in some instances at least strut member may have end portions and an intermediate portion defining a common overall shape e.g. curvature.

At least one strut member may take the form of a bow spring element.

The strut members may form or define blades of the centraliser.

The strut members may be circumferentially arranged around the first and second end collars.

The strut members may be circumferentially spaced around the first and second end collars.

In particular embodiments, the strut members are bifurcated.

The strut members may comprise or define a convex outer surface along a length, for example, an entire length between the end collars.

The strut members may comprise at least one of: a convex, flat or concave section along the length of the member.

The strut members may comprise or define a convex outer surface along part of the length of the members and may comprise or define at least one of: a flat; and concave outer surface along another part of the length of the member.

The direction defined between adjacent members of the centraliser may define a circumferential direction with respect to the centraliser.

The end collars may be coaxial with respect to an axis of the centraliser such that the circumferential direction may be defined in relation to the axis of the centraliser.

The end portions may comprise or define at least one of: a curved, convex, concave or flat outer surface in at least one of: a direction defined along; and across the member.

The at least one of: the curved, convex, concave or flat outer surface may be defined in a direction defined between adjacent members of the centraliser and/or between the end collars of the centraliser.

In an initial, non-deformed condition or an at least partially-deformed condition, the centraliser may assume the larger diameter configuration, which may define a first radius of curvature.

The centraliser may enter the bore in the initial non-deformed condition, and may subsequently be partially deformed to assume the partially-deformed configuration according to the diameter of the bore.

The first radius of curvature may be defined by a radius of the bore.

The curved or convex outer surface of the members may define a second radius of curvature, which may be defined in a direction across the members.

The second radius of curvature may be equal to or less than the first radius of curvature such as at least in the non-deformed condition or an at least partially-deformed condition of the centraliser.

The curved or convex outer surface of the members may comprise a portion, for example a central portion or the like, that is contactable with the bore wall.

The curved or convex outer surface of the members may comprise a portion, for example an edge portion or the like, that is not contactable with the bore wall in the non-deformed or partially deformed configurations.

If the centraliser is deformed, in some circumstances, the edge portions may be in contactable with the bore wall.

Providing edge portions, which may not be contactable with the bore wall, may reduce the friction between the members and the bore wall if moving the centraliser through the bore.

The first radius of curvature may correspond to a radius of curvature of the bore. By providing the second radius of curvature equal to or less than the first radius of curvature, the convex outer surface may have a reduced contact area between the intermediate portion and a bore wall. Reducing the contact area may reduce friction and/or ease passage of the centraliser through the bore.

The centraliser may be configured to assume a different diameter depending on a degree of deformation of the members. The centraliser may comprise at least one support element for restricting flexing or deformation of the members. Restricting flexing or deformation of the members may prevent the centraliser assuming a diameter smaller than a threshold diameter, which may ensure an at least partial recovery of the centraliser to a diameter larger than the threshold diameter.

In an initial condition, the centraliser may describe at least the first diameter, which may correspond to, be larger than, or smaller than the larger diameter configuration.

The centraliser may be reconfigurable to a deformed condition to describe a smaller second diameter to permit passage of the centraliser through a bore restriction.

The centraliser may be reconfigurable to a recovered condition to describe the first diameter and centralise the tubing in the bore.

In the deformed configuration, the degree of deformation of the members may be restricted to ensure recovery of the centraliser to the first diameter.

The second diameter may be equal to or more than the threshold diameter.

The at least one support element may be configurable to abut the tubing upon flexing or deformation of at least one of the members.

The at least one support element may be flexible or deformable.

The at least one support element may be configured to support at least one of: the intermediate portion and the end portions.

The at least one support element may be configured to support a radially outermost part of the members.

The at least one support element may be configured to support a portion of the members comprising a mid-way point between the end collars.

The radially outermost part of the member may define a crest or high point of the members.

The members may each comprise a convex outer surface defined circumferentially around the centraliser.

The outer surface may comprise a contact surface of the members.

The contact surface may be contactable with a wall of the bore.

The convex outer surface may be defined at least partially along a length of the member.

The convex outer surface may be defined at least partially across a width of the member.

The length of the member may be defined as part of the member extending in an axial or downhole direction with respect to the centraliser in the bore.

The width of the member may be defined as part of the member extending in a circumferential direction with respect to the centraliser in the bore.

A thickness of the member may be defined in a radial direction with respect to the centraliser in the bore.

In an initial, non-deformed condition, the centraliser may describe a first diameter that defines a first radius of curvature.

The convex outer surface of the members may each define a second radius of curvature.

The second radius of curvature may be equal to or less than the first radius of curvature.

The first radius of curvature may be defined circumferentially around the bore. The second radius of curvature may be defined circumferentially around the centraliser.

By providing the strut members with the second radius of curvature, there may be reduced friction between the centraliser and the bore when moving the centraliser through the bore. There may be reduced wear of the members due to this reduced friction.

The strut members may comprise at least one end portion for connecting the members to the end collars of the centraliser.

The strut members may comprise at least two end portions for connecting the member to an end collar of the centraliser.

The end portion may be bifurcated.

Providing more than one end portion for each member end may help to evenly distribute force around the end collar.

The strut members may comprise at least two end portions for connecting each end of each member to their respective end collars, wherein the connections between each adjacent end portion on each end collar are equally spaced apart circumferentially around the end collar. It will however be appreciated that in an example, the adjacent connections may not be equally spaced apart circumferentially around the end collar. Depending on the particular geometry of the centraliser, it may or may not be possible to distribute the end portion connections equally spaced apart circumferentially around the end collar. For example, larger diameter centralisers or centralisers comprising more than four, five or six members may provide sufficient space for accommodating equally spaced apart end portion connections while smaller diameter centralisers or centralisers comprising less than four, five or six members may not provide sufficient space for accommodating equally spaced apart end portion connections.

By providing an equal distance as defined between the end portions, there may be an even distribution of force at least partially circumferentially around the end collars of the centraliser. In use, for example in a horizontal section of bore, the centraliser members on the lower side of the bore may experience a greater degree of deformation than those centraliser members on the upper side of the bore. The centraliser members on the lower side of the bore may exert a greater force on the end collars than the force exerted on the end collars by the members on the upper side of the bore.

By providing end portion connections that are equally spaced apart circumferentially around the end collars, the force exerted on the end collars by the members may be more evenly distributed than in the case where the end portion connections are not equally spaced apart circumferentially around the end collars. This may reduce excessive stress or strain being applied to certain parts of the end collars, or indeed within any other part of the centraliser.

The at least one support element may comprise a concave outer surface. The outer surface of the support element may face a wall of the bore. The outer surface of the support element may not, in general, be contactable with the bore wall. The support element may comprise or have an arcuate form.

The support element may comprise a convex inner surface. The convex inner surface may face the casing, and may be moved to abut the casing e.g. in response to being passed through a bore restriction.

The at least one support element may extend from one end portion to another end portion of the members. The at least one support element may be arranged to apply a force between a first end and a second end of the members.

The at least one support element may be configured to apply a force on or resist a force applied by the members. The at least one support element may be configured to provide support at a mid-way point of the members. The mid-way point may be defined between the end collars. The at least one support element may be configured to provide support for the intermediate portion The at least one support element may be centred or symmetric about the mid-way point of the members.

The at least one support element may be configured to apply a force on or resist a force applied by the members. The at least one support element may be configured to provide support at a point along the members that is between a mid-way point and an end portion of the members.

The at least one support element may be positioned along the members so as to be located proximal to one end collar of the centraliser and distal to the other end collar of the centraliser.

The at least one support element may comprise at least one arcuate spring element. At least one support element may extend at least partially along a central portion of at least one of: the intermediate portion and the end portions. At least one support element may extend at least partially along a central portion of the members. At least one support element may extend at least partially along an edge of at least one of: the intermediate portion and the end portions. At least one support element may extend at least partially along an edge of the strut members.

The strut members may comprise or may be formed of a metal.

The centraliser may comprise at least one contact surface for contacting a wall of the bore.

The contact surface may comprise a friction-reducing coating.

The strut members may comprise the contact surface.

The friction-reducing coating may form part of the strut members.

The friction-reducing coating may comprise at least one of: polytetrafluoroethylene; and graphene or like material.

Any other appropriate coating may be applied to the strut members to reduce the friction between the strut members and the bore wall, or the strut members may be formed with or modified to comprise the friction-reduction coating. The strut members may comprise a metal.

By providing the strut members with the friction-reducing coating, there may be reduced friction between the centraliser and the wellbore when moving the centraliser through the wellbore. There may be reduced wear of the strut member due to the reduced friction.

The contact surface may comprise a friction-reducing coating forming part of the strut members.

The friction-reducing coating may comprise at least one of: polytetrafluoroethylene; and graphene or other suitable friction-reducing coating.

According to a second aspect, there is provided a method of centralising tubing in a bore using the centraliser of the first aspect.

The method may comprise providing a plurality of centralisers on a string of tubing.

The centralisers may comprise end collars connected by members for permitting the centraliser to assume a different diameter depending on a degree of deformation of the strut members.

The strut members may be restricted to prevent the centraliser assuming a diameter smaller than a threshold diameter.

The method may comprise running the tubing and the centralisers through a bore restriction to radially deform the centralisers.

The method may comprise running the tubing and the centralisers from the bore restriction into a bore section to ensure an at least partial recovery of the centralisers to a diameter larger than the threshold diameter.

The method may have particular utility in running tubing such as casing into inclined or horizontal bores, for example in bores for oil and/or gas wells, where the mass of the tubing will tend to compress or deform the centraliser members located between the tubing and the lower side of the bore. In the absence of restriction of the degree of deformation of the strut members, the strut members between the tubing and the low side of the bore will likely experience a greater degree of deformation than the strut members between the tubing and the high side of the bore and may experience excessive or non-recoverable deformation as the centralisers pass through the bore restriction. On the tubing passing into the bore section beyond the bore restriction, members that have experienced excessive deformation may not recover sufficiently to allow the centraliser to describe the first diameter and maintain the tubing coaxial with the bore.

With the present method the degree of deformation of individual members may be restricted to ensure that the strut members will recover sufficiently to maintain the tubing substantially coaxial with the bore. If the tubing and centralisers are being run through a horizontal tubing restriction there will be a tendency for the centraliser members between the tubing and the low side of the bore to experience a greater degree of deformation, however with the degree of deformation of individual members being restricted, the deformation is more likely to be more evenly distributed between the strut members.

The threshold diameter may define a minimum diameter of the centraliser, below which the strut members may experience excessive deformation to the extent that the excessively deformed members may not recover sufficiently to allow the centraliser to describe a larger target diameter upon moving into the bore section after the bore restriction. By restricting the strut members to prevent the centraliser assuming a diameter smaller than the threshold diameter, the centraliser may be capable of at least partially recovering to a larger diameter than the threshold diameter so as maintain the tubing substantially coaxial with the bore.

Those of skill in the art will recognise that with a deformable centraliser there will always be an inevitable degree of deformation of the strut members on the low side of the tubing in inclined or horizontal bores applications, and this is recognised by, for example, the American Petroleum Institute's Specification 10D for spring bow centralisers.

The centralisers may describe at least a first diameter in an initial condition. The method may comprise radially deforming the centralisers to describe a smaller second diameter defined by the bore restriction.

The centraliser may be in the initial condition before entering the bore.

The diameter of the bore may define the first diameter.

Upon entering the bore, the centralisers may be partially deformed to assume the first diameter.

The second diameter may be equal to or more than the threshold diameter. Upon being deformed in the bore restriction, the centralisers may not be deformed to a diameter less than the threshold diameter.

By only deforming the centralisers to a diameter equal to or more than the threshold diameter, the centralisers may not experience excessive deformation.

Restricting the strut members to prevent the centraliser assuming a diameter smaller than a threshold diameter may comprise providing at least one support element between the strut members and the tubing.

The at least one support element may be arranged to prevent deformation of the strut members resulting in the centraliser describing a diameter below the threshold diameter.

The method may comprise restricting deformation of the strut members by abutting the at least one support element against the tubing in response to a radial compression of at least one of the strut members.

The method may comprise moving the centralisers through a bore restriction in an inclined or horizontal bore section.

The method may comprise restricting members on a lower side of the centraliser from deforming excessively in response to a weight applied on the strut members by the tubing as the centraliser passes through the bore restriction.

Restricting members on the lower side of the centraliser from deforming may comprise supporting the tubing so that the tubing adopts a substantially coaxial position within at least one of: the bore restriction and the bore section.

Supporting the tubing may comprise providing at least one support element for maintaining the tubing in the substantially coaxial position. The at least one support element may resist deformation of the members on the lower side of the bore so as to maintain the tubing at a minimum radial distance above the lower sider of the bore. The minimum radial distance may be defined by the threshold diameter. The minimum radial distance may be defined by the diameter of the bore restriction. The minimum radial distance may be equal or approximately equal to half of the difference between the threshold or bore restriction diameter and the diameter of the tubing.

According to a third aspect, there is provided a strut member for a centraliser according to the first aspect, the strut member comprising:

a first end portion;

a second end portion;

an intermediate portion interposed between the first end portion and the second end portion; and one or more wing portions extending from the intermediate portion and which are angled relative to the intermediate portion.

The intermediate portion may have a greater stiffness than the first and second end portions.

According to a fourth aspect, there is provided a downhole assembly comprising at least one centraliser of the first aspect.

The assembly may comprise a plurality of the centralisers according to the first aspect.

The assembly may comprise tubing.

It will be understood that any of the features defined above or described below may be used alone or in combination.

DETAILED DESCRIPTION OF THE DRAWINGS

Figure 1:
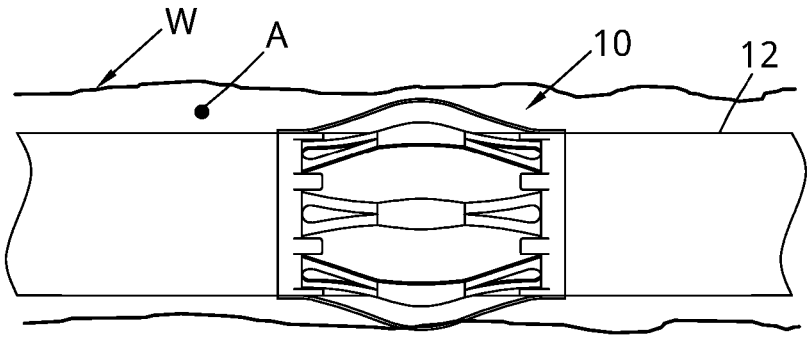
FIG. 1 shows a centraliser for centralising tubing in a wellbore.

Referring first to FIG. 1 of the accompanying drawings, there is shown a diagrammatic view of a centraliser 10 for use in centralising tubing 12 in a bore W. As shown in FIG. 1, the tubing 12 takes the form of a casing string and the bore W takes the form of a wellbore, the annulus A between the tubing 12 and the bore W then being filled with a settable material, such as cement, which supports the tubing 12 and the bore W and provides a seal preventing uncontrolled fluid flow up the annulus A.

In use, and will be described further below, the centraliser 10 is configured to engage the wall of the wellbore W to centralise the tubing 12 in the bore W.

Figure 2:
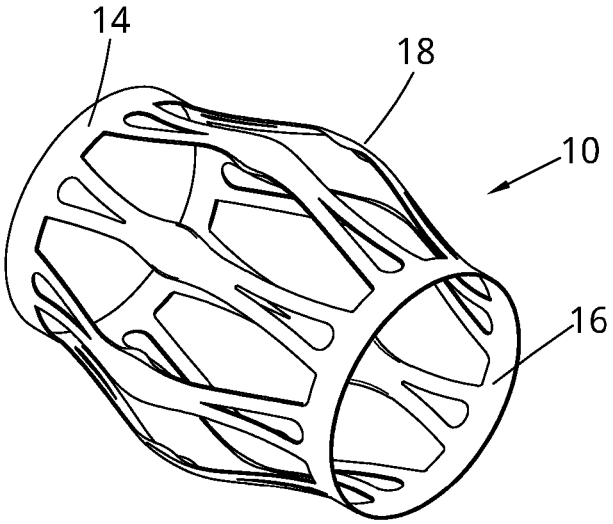
FIG. 2 shows a perspective view of the centraliser shown in FIG. 1.

FIG. 2 of the accompanying drawings shows a perspective view of the centraliser 10 shown in FIG. 1. As shown in FIG. 2, the centraliser 10 comprises a unitary construction having a first end collar 14, a second end collar 16 and a number of elongate strut members 18. The first and second end collars 14, 16 are generally cylindrical in shape and are configured to mount the centraliser 10 onto the tubing 12. The strut members 18 are interposed between the first end collar 14 and the second end collar 16 and are circumferentially arranged and spaced around the first end collar 14 and second end collar 16. In the illustrated centraliser 10, the centraliser 10 has eight strut members 18. However, it will be recognised that the centraliser 10 may have any suitable number of strut members 18. The strut members 18 form blades of the centraliser 10.

Figure 3:
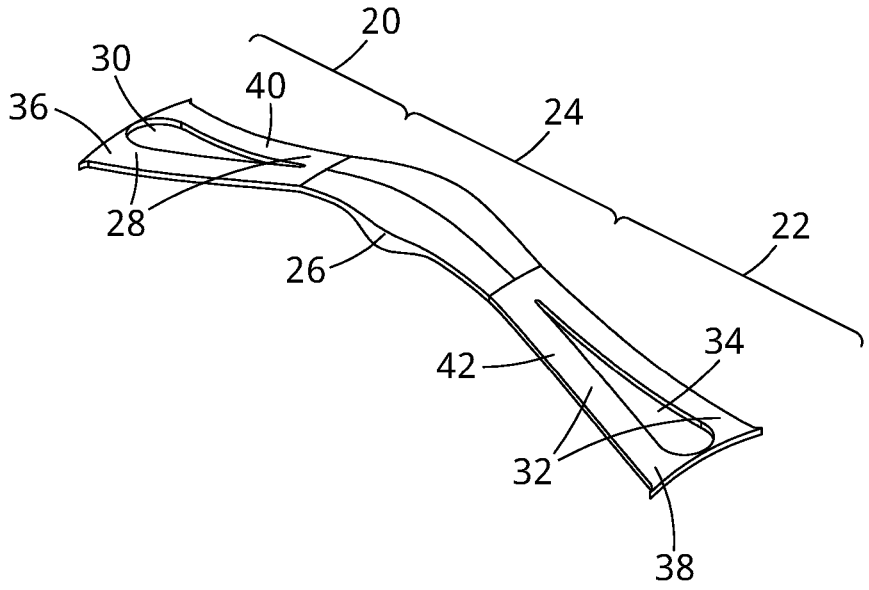
FIG. 3 shows an enlarged view of a strut member of the centraliser shown in FIG. 2, in isolation.
Figure 4:
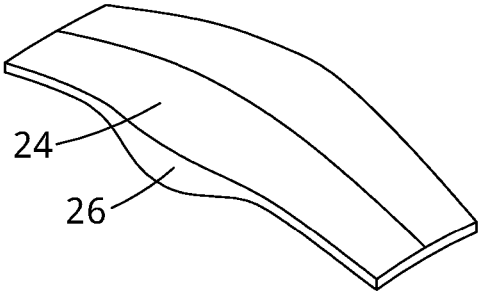
FIG. 4 shows a perspective view of the intermediate portion of the strut member shown in FIG. 3, in isolation.
Figure 5:
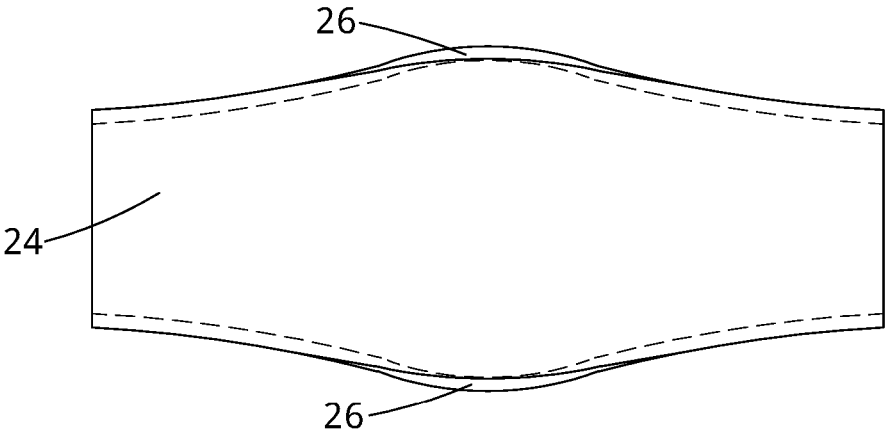
FIG. 5 shows a plan view of the intermediate portion shown in FIG. 3.

Referring now also to FIG. 3 of the accompanying drawings, which shows an enlarged view of one of the strut members 18 in isolation, it can be seen that the strut member 18 has a first end portion 20, a second end portion 22, an intermediate portion 24 and wing portions 26.

As shown in FIG. 3, the first end portion 20 of the strut member 18 is bifurcated, having two connector portions 28 for connecting the first end portion 20 to the first end collar 14. An aperture 30, which in the illustrated centraliser 10 takes the form of a teardrop-shaped aperture, is defined between the connector portions 28 and the first end collar 14. The second end portion 22 of the strut member 18 is also bifurcated, having two connector portions 32 for connecting the second end portion 22 to the second end collar 16. An aperture 34, which in the illustrated centraliser 10 also takes the form of a teardrop-shaped aperture, is defined between the connector portions 32 and the second end collar 16. In the illustrated centraliser 10, the connector portions 28, 32 diverge from the intermediate portion 24 so as to be spaced apart at the first and second end collars 14, 16.

In the illustrated centraliser 10, the connector portions 28, 32 each include a curved section 36, 38 proximal to the respective end collars 14, 16 and a non-curved section 40, 42, the curved sections 36, 38 by virtue of their shape having a greater stiffness than the non-curved sections 40, 42, thereby providing a transition between the end collars 14, 16 and the intermediate portion 24.

FIGS. 4 to 8 of the accompanying drawings shows the intermediate portion 24 of one of the strut members 18 of the centraliser 10.

As shown, the intermediate portion 24 is curved in both circumferential and axial directions and defines a convex curved outer surface. The curved shaped of the intermediate portion 24 provides for greater stiffness than the end portions 20, 22.

The wing portions 26 extend from the intermediate portion 24 and are angled relative to the intermediate portion 24. In the illustrated centraliser 10, the wing portions 26 define an angle of approximately 90 degrees to the intermediate portion 24. However, the wing portions 26 may define other angles with respect to the intermediate portion 24.

Figure 6:
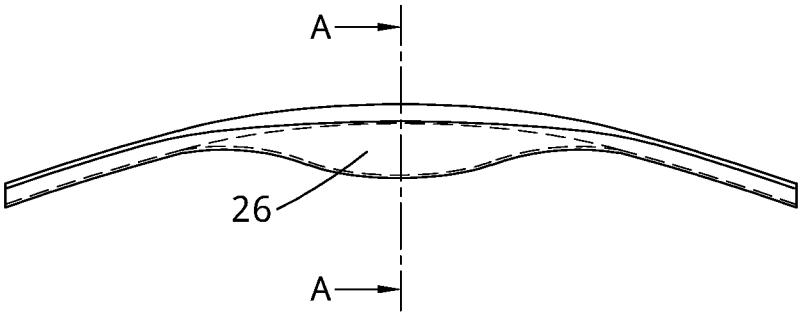
FIG. 6 shows a side view of the intermediate portion shown in FIG. 3.
Figure 7:
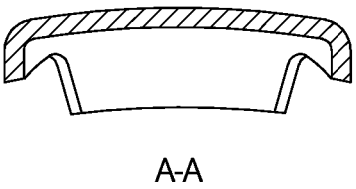
FIG. 7 shows cross-sectional view A-A of the intermediate portion shown in FIG. 6.
Figure 8:
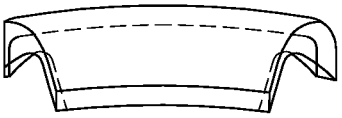
FIG. 8 shows an end view of the intermediate portion shown in FIG. 3.

As shown in FIG. 6, for example, the wing portions 24 are also curved in an axial direction.

The wing portions 26 have been found to further enhance the stiffness of the intermediate portion 24 relative to the end portions 20, 22. Moreover, the provision of the wing portions 26 which are angled relative to the intermediate portion 24 offsets the intermediate portion 24 from the tubing 12 in use.

Beneficially, the provision of a centraliser 10 having one or more strut members 18 with an intermediate portion 24 having a greater stiffness than the end portions of the strut member provides for preferential flexing of the strut member at the end portions rather than the intermediate portion. The preferential flexing of the strut members 18 at the intermediate portion provides a centraliser 10 having sufficient rigidity to maintain the tubing 12 in a generally central position in the bore W while also having sufficient flexibility to pass through wellbore restrictions and recover to the required shape. The provision of wing portions 26 has been found to further enhance the stiffness of the intermediate portion 24 relative to the end portions 20, 22. Moreover, the provision of the wing portions 28 which are angled relative to the intermediate portion 24 offsets the intermediate portion 24 from the tubing 12 in use.

It will be recognised that various modifications may be made without departing from the scope of the invention as defined in the claims.

Figure 9:
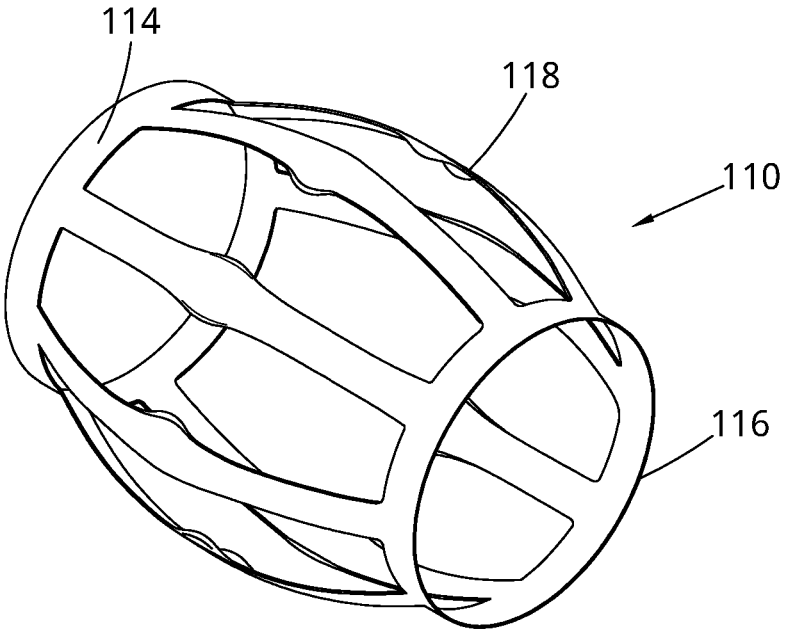
FIG. 9 shows an alternative centraliser for centralising tubing in a wellbore.

For example, FIG. 9 of the accompanying drawings shows an alternative centraliser 110 for centralising the tubing 12 in the bore W.

As shown in FIG. 9, the centraliser 110 comprises a unitary construction having a first end collar 114, a second end collar 116 and a number of elongate strut members 118. The first and second end collars 114, 116 are generally cylindrical in shape and are configured to mount the centraliser 110 onto the tubing 12. The strut members 118 are interposed between the first end collar 114 and the second end collar 116 and are circumferentially arranged and spaced around the first end collar 114 and second end collar 116. In the illustrated centraliser 110, the centraliser 110 has eight strut members 118. However, it will be recognised that the centraliser 110 may have any suitable number of strut members 118. The strut members 118 form blades of the centraliser 110.

Figure 10:
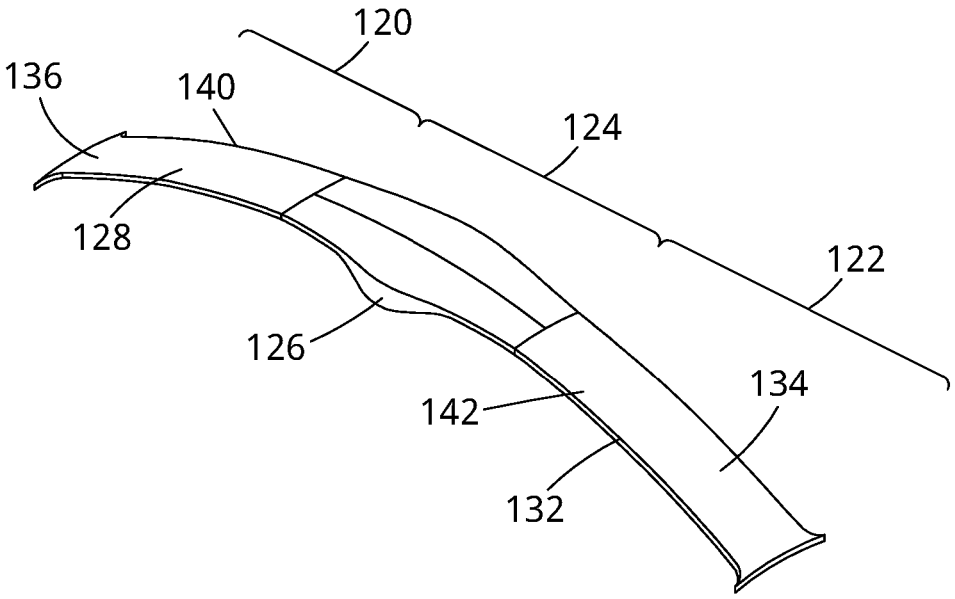
FIG. 10 shows an enlarged view of a strut member of the centraliser shown in FIG. 9, in isolation.

Referring now also to FIG. 10 of the accompanying drawings, which shows an enlarged view of one of the strut members 118 in isolation, it can be seen that the strut member 118 has a first end portion 120, a second end portion 122, an intermediate portion 124 and wing portions 126.

As shown in FIG. 10, unlike the strut member 18 described above, the first end portion 120 of the strut member 118 is not bifurcated, having a single connector portion 128 for connecting the first end portion 120 to the first end collar 114 and a connector portion 132 for connecting the second end portion 122 to the second end collar 116. In the illustrated centraliser 110, the end portions define a convex outer surface.

In the illustrated centraliser 110, the connector portions 128, 132 each include a curved section 136, 138 proximal to the respective end collars 114, 116 and a non-curved section 140, 142, the curved sections 136,138 by virtue of their shape having a greater stiffness than the non-curved sections 140,142, thereby providing a transition between the end collars 114, 116 and the intermediate portion 124.

As shown in FIGS. 9 and 10, the intermediate portion 124 is curved in both circumferential and axial directions and defines a convex curved outer surface. The curved shaped of the intermediate portion 124 provides for greater stiffness than the end portions 120,122.

The wing portions 126 extend from the intermediate portion 124 and are angled relative to the intermediate portion 124. In the illustrated centraliser 110, the wing portions 126 define an angle of approximately 90 degrees to the intermediate portion 124. However, the wing portions 126 may define other angles with respect to the intermediate portion 124.

As shown in FIG. 10, for example, the wing portions 124 are also curved in an axial direction.

As described above, the wing portions 126 have been found to further enhance the stiffness of the intermediate portion 124 relative to the end portions 120, 122. Moreover, the provision of the wing portions 126 which are angled relative to the intermediate portion 124 offsets the intermediate portion 124 from the tubing 12 in use.

FIG. 9 of the accompanying drawings shows an alternative centraliser 110 for centralising the tubing 12 in the bore W. Like components between the centralisers 10, 110 are represented by like reference signs incremented by 100.

As shown in FIG. 9, the centraliser 110 comprises a unitary construction having a first end collar 114, a second end collar 116 and a number of elongate strut members 118. The first and second end collars 114, 116 are generally cylindrical in shape and are configured to mount the centraliser 110 onto the tubing 12. The strut members 118 are interposed between the first end collar 114 and the second end collar 116 and are circumferentially arranged and spaced around the first end collar 114 and second end collar 116. In the illustrated centraliser 110, the centraliser 110 has eight strut members 118. However, it will be recognised that the centraliser 110 may have any suitable number of strut members 118. The strut members 118 form blades of the centraliser 110.

Referring now also to FIG. 10 of the accompanying drawings, which shows an enlarged view of one of the strut members 118 in isolation, it can be seen that the strut member 118 has a first end portion 120, a second end portion 122, an intermediate portion 124 and wing portions 126.

As shown in FIG. 10, unlike the strut member 18 described above, the first end portion 20 has a single connector portion 128 for connecting the first end portion 120 to the first end collar 114 and a connector portion 132 for connecting the second end portion 122 to the second end collar 116. In the illustrated centraliser 110, the connector portions 128, 132 each include a curved section 136, 138 proximal to the respective end collars 114, 116 and a non-curved section 140, 142, the curved sections 136, 138 by virtue of their shape having a greater stiffness than the non-curved sections 140, 142, thereby providing a transition between the end collars 114, 116 and the intermediate portion 124.

As shown in FIGS. 9 and 10, the intermediate portion 124 is curved in both circumferential and axial directions and defines a convex curved outer surface. The curved shaped of the intermediate portion 124 provides for greater stiffness than the end portions 120,122.

The wing portions 126 extend from the intermediate portion 124 and are angled relative to the intermediate portion 124. In the illustrated centraliser 110, the wing portions 126 define an angle of approximately 90 degrees to the intermediate portion 124. However, the wing portions 126 may define other angles with respect to the intermediate portion 124.

As shown in FIG. 10, for example, the wing portions 124 are also curved in an axial direction.

In use, the centraliser 110 may be configured for location on the tubing 12, the centraliser 110 configured to engage the wall of the bore W to centralise the tubing 12 in the bore W. The provision of a centraliser 110 having one or more strut members 118 with an intermediate portion 124 having a greater stiffness than the end portions 120,122 of the strut member 118 provides for preferential flexing of the strut member 118 at the end portions 120,122 rather than the intermediate portion 124. The preferential flexing of the strut member 118 at the intermediate portion provides a centraliser 110 having sufficient rigidity to maintain the tubing 12 in a generally central position in the bore W while also having sufficient flexibility to pass through wellbore restrictions and recover to the required shape. The provision of wing portions 126 has been found to further enhance the stiffness of the intermediate portion relative to the end portions 120, 122. Moreover, the provision of the wing portions 126 which are angled relative to the intermediate portion 124 offsets the intermediate portion 124 from the tubing 12 in use.

Figure 11:
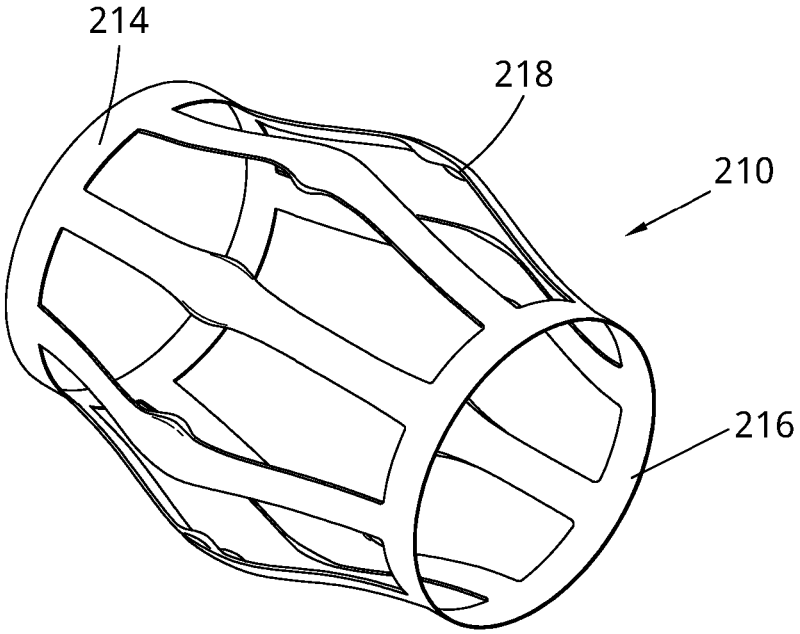
FIG. 11 shows an alternative centraliser for centralising tubing in a wellbore.

FIG. 11 of the accompanying drawings shows another alternative centraliser 210 for centralising the tubing 12 in the bore W. Like components between the centralisers 10, 210 are represented by like reference signs incremented by 200.

As shown in FIG. 11, the centraliser 210 comprises a unitary construction having a first end collar 214, a second end collar 216 and a number of elongate strut members 218. The first and second end collars 214, 216 are generally cylindrical in shape and are configured to mount the centraliser 210 onto the tubing 12. The strut members 218 are interposed between the first end collar 214 and the second end collar 216 and are circumferentially arranged and spaced around the first end collar 214 and second end collar 216. In the illustrated centraliser 210, the centraliser 210 has eight strut members 218. However, it will be recognised that the centraliser 210 may have any suitable number of strut members 218. The strut members 218 form blades of the centraliser 210.

Figure 12:
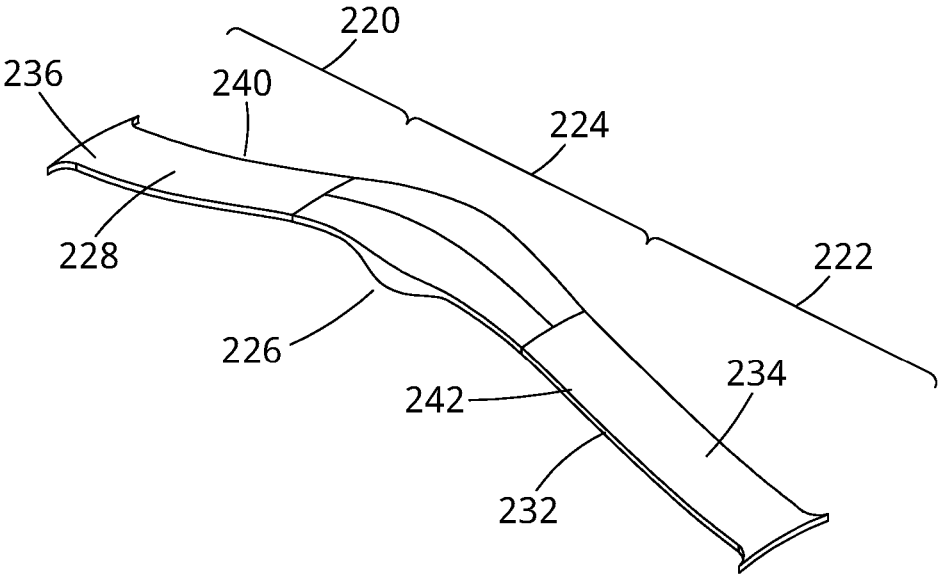
FIG. 12 shows an enlarged view of a strut member of the centraliser shown in FIG. 11, in isolation.

Referring now also to FIG. 12 of the accompanying drawings, which shows an enlarged view of one of the strut members 218 in isolation, it can be seen that the strut member 218 has a first end portion 220, a second end portion 222, an intermediate portion 224 and wing portions 226.

As shown in FIG. 12, like the centraliser 110, the first end portion 220 has a single connector portion 228 for connecting the first end portion 220 to the first end collar 214 and a connector portion 232 for connecting the second end portion 222 to the second end collar 216. In the illustrated centraliser 210, the end portions define a concave outer surface.

In the illustrated centraliser 210, the connector portions 228, 232 each include a curved section 236, 238 proximal to the respective end collars 214, 216 and a non-curved section 240, 242, the curved sections 236, 238 by virtue of their shape having a greater stiffness than the non-curved sections 240, 242, thereby providing a transition between the end collars 214, 216 and the intermediate portion 224.

As shown in FIGS. 11 and 12, the intermediate portion 224 is curved in both circumferential and axial directions and defines a convex curved outer surface. The curved shaped of the intermediate portion 224 provides for greater stiffness than the end portions 220, 222.

The wing portions 226 extend from the intermediate portion 224 and are angled relative to the intermediate portion 224. In the illustrated centraliser 210, the wing portions 226 define an angle of approximately 90 degrees to the intermediate portion 224. However, the wing portions 226 may define other angles with respect to the intermediate portion 224.

As shown in FIG. 12, for example, the wing portions 224 are also curved in an axial direction.

In use, the centraliser 210 may be configured for location on the tubing 12, the centraliser 210 configured to engage the wall of the bore W to centralise the tubing 12 in the bore W. The provision of a centraliser 210 having one or more strut members 218 with an intermediate portion 224 having a greater stiffness than the end portions 220, 222 of the strut member 218 provides for preferential flexing of the strut member 218 at the end portions 220, 222 rather than the intermediate portion 224. The preferential flexing of the strut member 218 at the intermediate portion provides a centraliser 210 having sufficient rigidity to maintain the tubing 12 in a generally central position in the bore W while also having sufficient flexibility to pass through wellbore restrictions and recover to the required shape. The provision of wing portions 226 has been found to further enhance the stiffness of the intermediate portion relative to the end portions 220, 222. Moreover, the provision of the wing portions 226 which are angled relative to the intermediate portion 224 offsets the intermediate portion 224 from the tubing 12 in use Referring now to FIG. 13 of the accompanying drawings, there is shown a downhole assembly 1000 comprising a plurality of centralisers 1010. In the illustrated assembly 1000, the centralisers 1010 are identical to the centraliser 10 shown in FIG. 1. However, it will be understood that one or more of the centralisers 1010 may be identical to the centraliser 110 or centraliser 210 described above.

Figure 13:
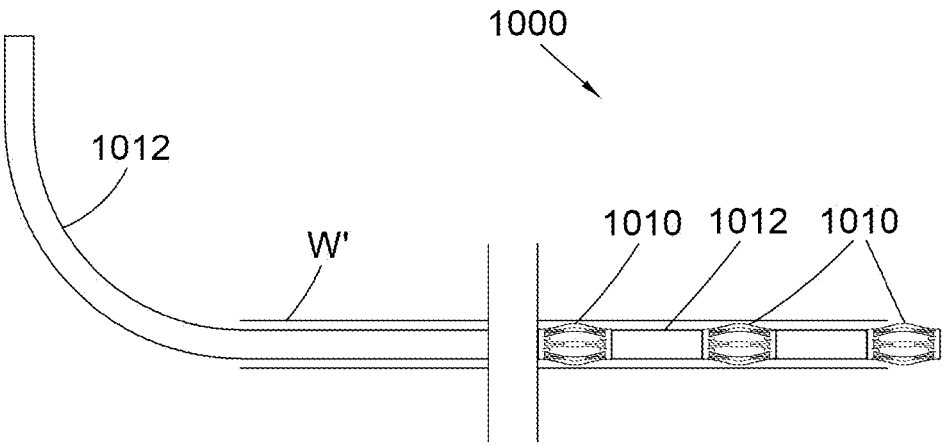
FIG. 13 shows a diagrammatic view of a downhole assembly.

As shown in FIG. 13, the centralisers 1010 are disposed on tubing 1012 which takes the form of a bore-lining tubing string, and more particularly a casing string, the tubing 1012 configured to be run into a bore W' in the form of a wellbore. In use, the centralisers 1010 centralise the tubing 1012 in the bore W' as described above.

Figure 14:
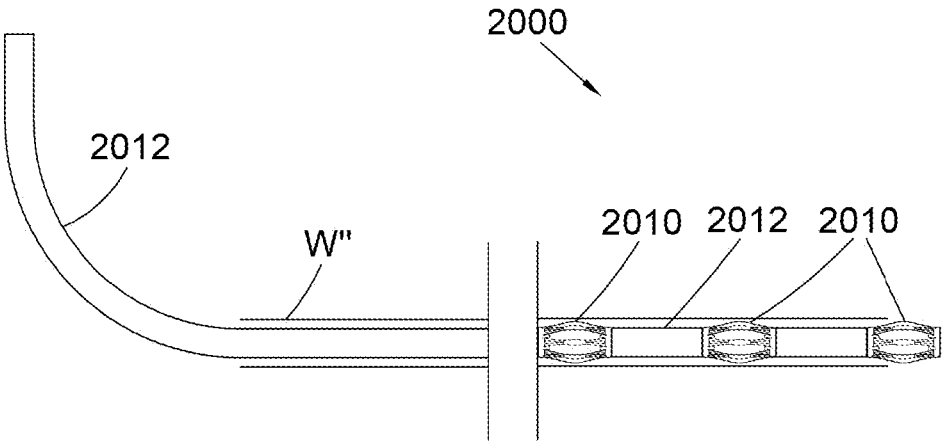
FIG. 14 shows a diagrammatic view of an alternative downhole assembly.

An alternative downhole assembly 2000 is shown in FIG. 14 of the accompanying drawings. In the illustrated assembly 2000, the centralisers 2010 are identical to the centraliser 10 shown in FIG. 1. However, it will be understood that one or more of the centralisers 2010 may be identical to the centraliser 110 or centraliser 210 described above.

As shown in FIG. 14, the centralisers 2010 are disposed on tubing 2012 which takes the form of a tubing string, and more particularly a work string, the tubing 2012 configured to be run into a bore W" in the form of a cased bore. In use, the centralisers 2010 centralise the tubing 1012 in the bore W" as described above.

The invention claimed is:

1. A centraliser for use in centralising tubing in a bore, comprising:

a first end collar;

a second end collar; and a plurality of strut members interposed between the first end collar and the second end collar, wherein at least one of the strut members comprises:

a first end portion;

a second end portion;

an intermediate portion interposed between the first end portion and the second end portion; and one or more wing portions extending from the intermediate portion and which are angled inwards relative to the intermediate portion, wherein the first end collar, the second end collar, and the strut members are integrally formed together, and wherein the one or more wing portions are integrally formed with the intermediate portion, the one or more wing portions comprising a bent or folded portion of the intermediate portion.

2. The centraliser of claim 1, wherein the intermediate portion has a greater stiffness than the first end portion and the second end portion.

3. The centraliser of claim 1, wherein the centraliser is configurable in a first, larger diameter, configuration in which the intermediate portion assumes a radially extended position and in a second, smaller diameter, configuration in which the intermediate portion assumes a radially retracted position.

4. The centraliser of claim 3, wherein the centraliser is reconfigurable from the first, larger diameter, configuration to the second, smaller diameter, configuration.

5. The centraliser of claim 3, wherein the centraliser is reconfigurable from the second, smaller diameter, configuration to the first, larger diameter, configuration.

6. The centraliser of claim 1, wherein the end portions of the strut members are configured to permit reconfiguration between the first, larger diameter, configuration and the second, smaller diameter, configuration.

7. The centraliser of claim 6, wherein the end portions are relatively less stiff than the intermediate portion.

8. The centraliser of claim 1, wherein at least part of each wing portion is curved.

9. The centraliser of claim 8, wherein the wing portions are curved in a circumferential direction.

10. The centraliser of claim 8, wherein the wing portions are curved in an axial direction.

11. The centraliser of claim 1, wherein the strut members are bifurcated.

12. The centraliser of claim 1, wherein at least part of the intermediate portion is curved.

13. The centraliser of claim 12, wherein the intermediate portion is curved in a circumferential direction.

14. The centraliser of claim 12, wherein the intermediate portion is curved in an axial direction.

15. A method of centralising tubing in a bore using the centraliser of claim 1, comprising:

providing the centraliser of claim 1;

locating the centraliser on the tubing; and running the tubing and the centraliser into the bore, the centraliser being configured to engage the bore to centralise the tubing in the bore.

16. A downhole assembly comprising at least one centraliser according to claim 1.

17. The centraliser of claim 1, wherein one or more of the wing portions define a non-zero angle relative to the intermediate portion up to and including 180 degrees.

18. The centraliser of claim 17, wherein one or more of the wing portions define a non-zero angle relative to the intermediate portion up to and including 90 degrees or about 90 degrees.

19. The centraliser of claim 1, wherein one or more of the strut members comprise two wing portions.

20. The centraliser of claim 19, wherein the wing portions define different angles with respect to the intermediate portion.

* * * * *